United States Patent [19]

Van Malderghem

[11] 4,002,290

[45] Jan. 11, 1977

[54] ENVELOPE ASSEMBLY

[75] Inventor: Edmund G. Van Malderghem, Lewiston, N.Y.

[73] Assignee: Moore Business Forms, Inc., Niagara Falls, N.Y.

[22] Filed: Jan. 12, 1976

[21] Appl. No.: 648,059

Related U.S. Application Data

[63] Continuation-in-part of Ser. No. 495,924, Aug. 8, 1974, Pat. No. 3,941,307.

[52] U.S. Cl. ..... 229/69; 229/85

[51] Int. Cl.[2] ..... B65D 27/10

[58] Field of Search ..... 229/69, 85; 282/11.5 R, 282/11.5 A, 25

[56] References Cited

UNITED STATES PATENTS

| | | | |
|---|---|---|---|
| 3,088,754 | 5/1963 | Burgmer | 282/11.5 A |
| 3,104,799 | 9/1963 | Steidinger | 229/69 |
| 3,325,188 | 6/1967 | Hiersteiner | 229/69 X |
| 3,339,827 | 9/1967 | Steidinger | 229/69 |
| 3,419,286 | 12/1968 | Noonan et al. | 229/69 X |
| 3,554,438 | 1/1971 | Van Malderghem | 229/69 |
| 3,777,971 | 12/1973 | Steidinger | 229/69 X |
| 3,905,545 | 9/1975 | Juszak et al. | 229/69 |

FOREIGN PATENTS OR APPLICATIONS

| | | | |
|---|---|---|---|
| 790,434 | 7/1968 | Canada | 229/69 |

*Primary Examiner*—Stephen P. Garbe
*Attorney, Agent, or Firm*—Watson, Cole, Grindle & Watson

[57] ABSTRACT

Sealed envelopes of a continuous envelope assembly each include front and back panels and a return envelope contained therein. The return envelope is free of attachment to the sealed envelope along all its marginal edges, and is constructed as having a protective portion overlying its flap with such portion being attached to the sealed envelope so as to be retained therewith upon extraction of the return envelope. The return envelope is immobilized within the sealed envelope by retention chips in abutting engagement with the marginal edges of the return envelope. These retention chips are secured to the outer envelope and are defined by severed extensions of the return envelope.

7 Claims, 7 Drawing Figures

ENVELOPE ASSEMBLY

RELATED APPLICATION

This application is a continuation-in-part of U.S. Ser. No. 495,924, filed Aug. 8, 1974, and now U.S. Pat. No. 3,941,307.

BACKGROUND OF THE INVENTION

This invention relates generally to an envelope assembly, and more particularly to an assembly of series connected envelopes each having a return envelope therein immobilized against relative shifting by retention means in abutting engagement with the marginal edges thereof, and the return envelope being so constructed so as to avoid accidental removal of its closing flap after extraction.

In my co-pending U.S. application Ser. No. 495,924, commonly owned herewith, an envelope assembly is disclosed as having a return envelope contained therein and is constructed in such a manner that the protective cover for its flap is retained within the envelope upon extraction. Hence, any accidental removal of the flap together with its protective covering is thereafter substantially avoided. Also, the return envelope in my prior application is connected along opposite sides thereof to the sealed envelope by means of lines of perforations defining weak connecting ties to prevent any relative movement between the return envelope and the sealed envelope during processing of the continuous assembly.

In co-pending U.S. application Ser. No. 621,165, in which I am named as a joint inventor and which is commonly owned herewith, a stuffed, sealed continuous envelope assembly is disclosed wherein the envelopes contain inserts immobilized against shifting and maintained in registration position but unattached within the envelopes thereby effecting easier extraction of the insert and a positive immobilization of the inserts regardless of their limited size changes.

The drawbacks in the envelope assemblies of both the aforementioned applications include the lack of any provision for a return envelope immobilized against shifting in its sealed envelope without the use of attachment means while at the same time being so constructed that a protective strip for its flap is retained in the outer envelope upon extraction.

SUMMARY OF THE INVENTION

It is therefore an object of this invention to provide a continuous envelope assembly of series connected envelopes as an improvement over the envelope assemblies of the aforementioned patent applications. The return envelope or return mailer of the present construction is immobilized against shifting and is maintained in registration position although it is unattached within the outer envelope so as to render it more easily extractable while at the same time a cover strip is provided for the return envelope flap which strip is retained with the outer envelope upon extraction.

Pursuant to this objective, the return envelope is immobilized by means of retention chips or elements secured to the outer envelope and abutting against marginal edges of the return envelope so as to prevent any relative shifting thereof during processing of the assembly. And, the return envelope is so constructed as having a removable protective strip overlying its flap and being retained with the outer envelope upon extraction so as to avoid the need for subsequently removing this protective cover before sealing the return envelope. As a result, positive immobilization of the insert material without regard to their limited size changes is made possible, the insert material is made more easily extractable, and the glue flap of the return envelope is automatically exposed upon extraction thereby avoiding any need for removal of the protective covering by the user.

Other objects, advantages and novel features of the invention will become more apparent from the following detailed description of the invention when taken in conjunction with the accompanying drawings.

DESCRIPTION OF THE INVENTION

Figure 1:
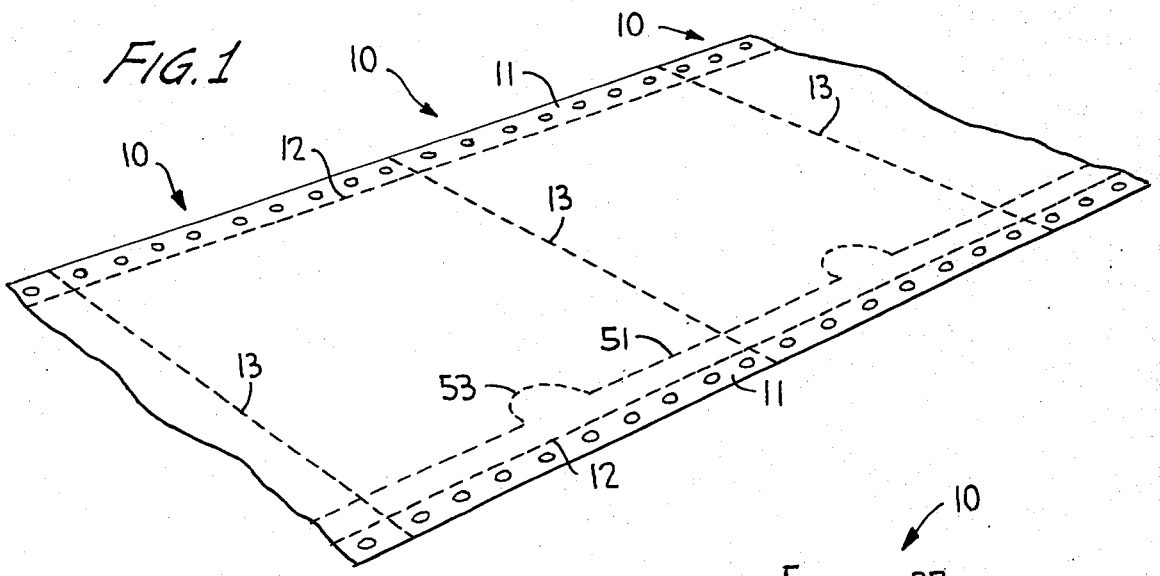
FIG. 1 is a fragmentary perspective view, on a slightly reduced scale, of an envelope assembly of interconnected sealed envelopes in accordance with the invention.
Figure 2:
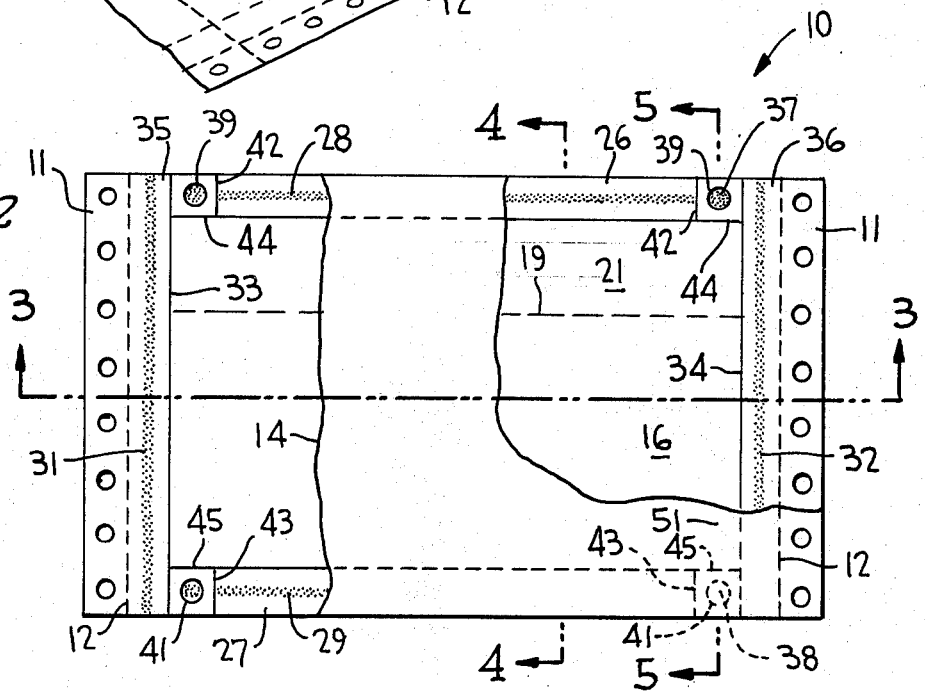
FIG. 2 is a plan view of one embodiment of an envelope of FIG. 1 shown partly broken away.
Figure 3:
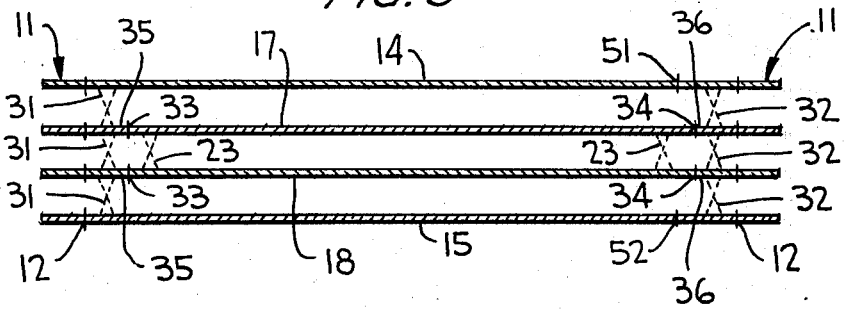
FIGS. 3, 4 and 5 are expanded sectional views of the outer envelope containing the return mailer taken along lines 3—3, 4—4 and 5—5, respectively, of FIG. 2.

Turning now to the drawings wherein like reference characters refer to like and corresponding parts throughout the several views, a sealed outer envelope assembly 10 is shown in FIG. 2 constructed in accordance with the present invention and after it has been burst or separated from the continuous manifold assembly of FIG. 1. As in the aforementioned applications, the FIG. 1 manifold assembly is constructed of a plurality of superimposed plies of continuous webs imprinted with indicia. A record sheet or sheets (not shown) of standard construction may be disposed over or under the continuous plies forming the envelopes which are together fed through the web processing equipment by means of marginally punched feed bands 11 located along opposite sides of the web in the direction of the feed and being removable therefrom along lines 12 of weakening. And, envelope assemblies 10 are typically series connected together along transverse lines 13 of weakening so as to be separable therealong when burst from the manifold assembly.

FIGS. 2 to 6 specifically illustrate one embodiment of the invention wherein each envelope assembly 10 comprises front and back panels 14 and 15 with insert material in the form of a return envelope or mailer 16 disposed therebetween. Additional insert material in the form of insert sheets may likewise be disposed between the panels of the outer envelope without departing from the scope of the invention.

The return mailer is similar to that disclosed in the aforementioned application Ser. No. 495,924 and comprises upper and lower panels 17 and 18 with the upper panel having fold line 19 therein transversely to the side feed bands as particularly shown in FIGS. 2 and 6. This fold line defines a flap 21 for closing the open-top return mailer after extraction. Accordingly, the flap may be provided with remoistenable glue 22 along its top edge similar as in application Ser. No. 495,924.

Figure 6:
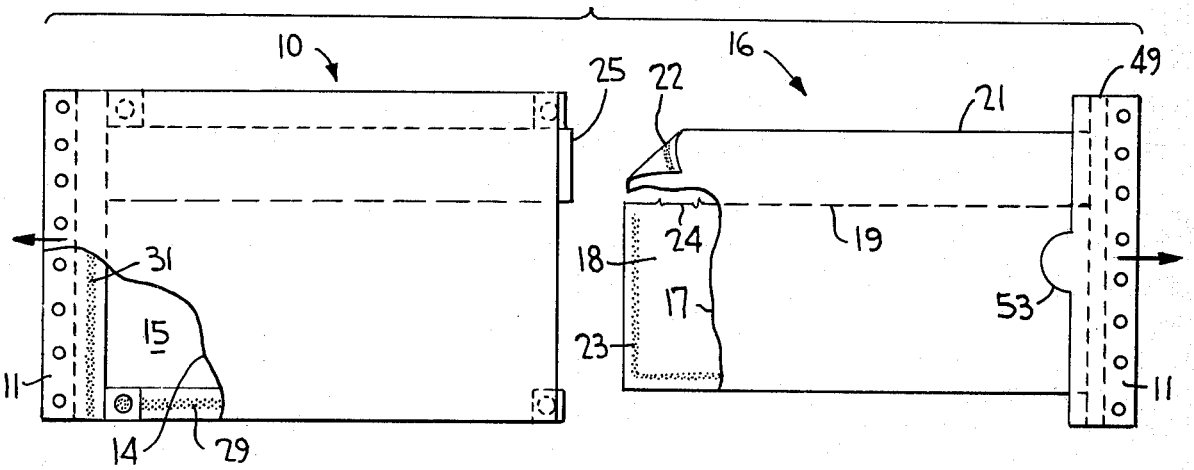
FIG. 6 is a plan view similar to FIG. 2 with the return mailer contained within the outer envelope shown fully extracted therefrom.

The front and back panels of the return envelope are interconnected along a U-shaped pattern pasted configuration 23 extending to fold line 19 as typically shown in FIG. 6. Also, lower ply 18 of the return envelope is provided with a line 24 of weakening superimposed over fold line 19 so as to define a protective strip 25 covering flap 21 and its glue stream 22.

Figure 4:
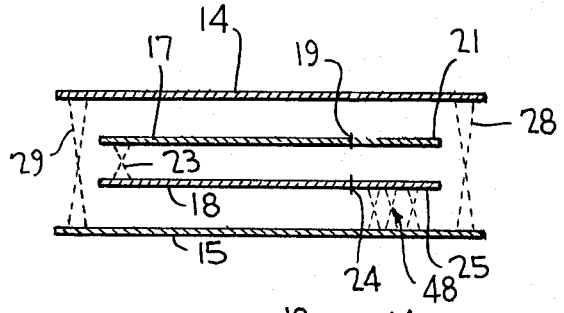
Figure 5:
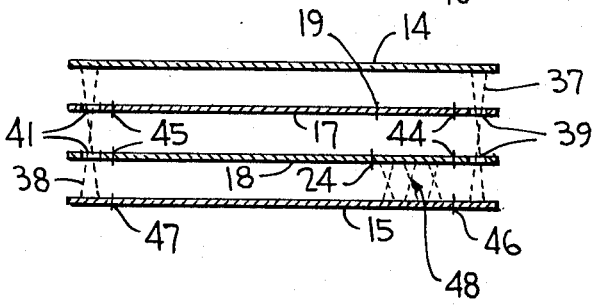

Return envelopes 16 are typically formed of continuous webs interconnected along transverse lines of weakening so as to form upper and lower panels 17 and 18 which are diecut as at 26 and 27 through which the front and back panels of the outer envelope are connected together along their top and bottom by streams 28 and 29 of adhesive as shown in FIG. 4. And, the front and back panels of the outer envelope are secured together along their short sides via the panels of the return envelope by streams 31 and 32 of adhesive as typically shown in FIG. 3. At some designated time during the assembly operation of the continuous envelopes, the upper and lower panels of the return mailers are slit along lines 33 and 34 thereby delimiting the opposite sides of the return mailers. Chip elements 35 and 36 are thereby produced which now abuttingly engage the opposite side edges of the return envelope so as to prevent it from shifting side-by-side during processing of the manifold assembly. The upper and lower panels of the return envelopes are otherwise connected to the front and back panels of the outer envelope by means of spots 37 and 38 of adhesive extending through holes 39 and 41 in the return envelope panels as typically shown in the application Ser. No. 621,165 and in FIG. 5 of the present drawings. As shown in FIG. 2, holes 39 and 41 are located in extensions 42 and 43 which become chip blocks 42 and 43 after they are severed from the remainder of the upper and lower panels along slits 44 and 45. Such a severing operation takes place during some convenient stage of the web processing operation so as to result in a construction whereby the return envelope is completely unattached from the outer envelope. Slits 44 and 45 may be made through back panel 15 of the outer envelope as at 46 and 47 shown in FIG. 5 to function similarly as those small cuts made in back ply of the Ser. No. 621,165 envelope assembly, i.e., for completely separating the chip blocks from their respective panels and for providing vents in the outer envelope to permit any entrapped air therein to escape. By reason of chip elements 35 and 36 and chip blocks 42 and 43, the return envelope is maintained in proper registration position within its outer envelope but unattached thereto, and is prevented from shifting in both directions as these chip blocks and elements abut against the marginal edges of the panels forming the return envelope.

The protective strip or waste chip 25 of the return envelope is adhesively secured as at 48 to the inner surface of back panel 15 of the outer envelope. Alternatively the waste chip may be secured to an insert sheet as shown in Ser. No. 495,924. And, a tear strip 49 is provided on the envelope assembly which is defined by lines 51 and 52 of weakening in the front and back panels. As clearly seen in FIGS. 3 and 6, the tear strip so defined overlaps an edge of the return envelope, and thumb notches 53 may likewise be provided for further overlapping such edge so as to permit the ultimate recipient of the envelope assembly to firmly grip that edge of the return envelope as the tear strip is moved in a direction away from the remainder of the envelope assembly as shown in FIG. 6. Return envelope 16 is thereupon freely extracted from the outer envelope by a snapping action as the tear strip and the outer envelope are moved in the directions of the opposite arrows of FIG. 6. Waste chip 25 is accordingly retained with the outer envelope since it is secured thereto; otherwise, the return envelope is freely and easily removed without the need for the breaking of any connecting ties as heretofore required.

Figure 7:
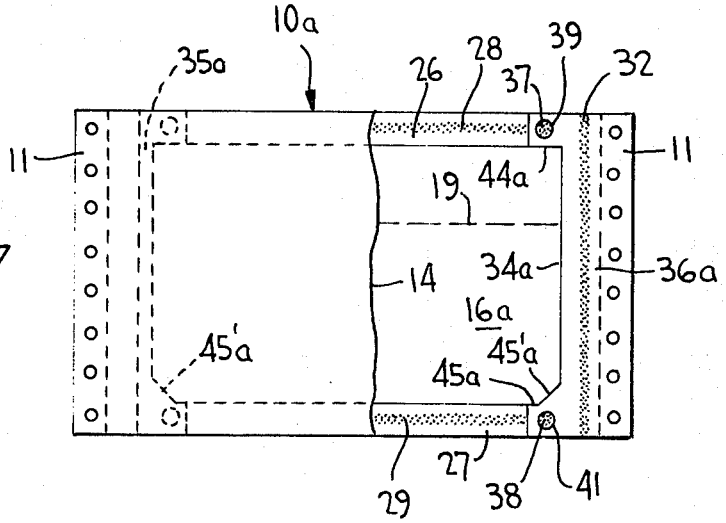
FIG. 7 is a view similar to FIG. 2 of another embodiment broken away for clarity.

In accordance with another embodiment of the invention, similar to the second embodiment of Ser. No. 621,165 except that the insert material comprises a return envelope herein, sealed envelope **10*a* is stuffed with return mailer 16*a* as shown in FIG. 7. The principal difference over the FIG. 2 embodiment is that the return mailer is immobilized within its sealed envelope by chip elements 35*a*, 36*a* which are substantially U-shaped in configuration. These chip elements abut against the opposite short sides of the panels forming the return envelope, and each chip has short extensions forming the legs of the U lying on opposite long sides of the return envelope panels. The chip elements may be formed similarly as in FIG. 2, i.e., at the time diecuts 26 and 27 are made in the return mailer. Thus, cuts 44*a*, 34*a* and 45*a* are made together with the diecuts. However, since the lines formed by cuts 34*a* and 45*a* do not intersect, small portions remain at the opposite lower corners of the return mailer so as to thereby retain the insert attached to the opposing chip elements. Thereafter, small angular cuts 45'*a* are made through one of the outer envelope panels in such a manner as to join cuts 34*a* and 45*a* as shown in FIG. 7 so as to thereby completely free the return envelope from any attachment whatsoever to the chip elements or to any other portion of the outer envelope. Such cuts 45'*a*** likewise serve the purpose of venting the sealed envelope from any entrapped air therein.

From the foregoing it can be seen that the envelope assembly constructed in accordance with the present invention permits the return envelope to be easily and quickly extracted while at the same time causes the waste chip to be retained with the outer envelope upon extraction. This waste chip serves as a protective covering for the return envelope flap, while the retention chips abutting against the marginal edges of the return envelope immobilizes it within the outer envelope. In such manner, the return envelope is maintained in proper registration within the sealed envelope by reason of the retention elements snugly embracing the short sides and a portion of the long sides of the panels forming the return envelope.

Obviously, many modifications and variations of the invention are made possible in the light of the above teachings. It is therefore to be understood that within the scope of the appended claims, the invention may be practiced otherwise than as specifically described.

What is claimed is:

1. A continuous envelope assembly having spaced transverse lines of weakening defining a succession of interconnected sealed envelopes, comprising: front and back panels, and insert material within each sealed envelope, said insert material at least comprising interconnected upper and lower panels forming a return envelope, one of said return envelope panels being separable along a keen line of weakening provided therealong, the other of said return envelope panels having a flap foldable over and securable to said one panel for closing said return envelope, said panels of said return envelope being so constructed that all marginal edges thereof are free from attachment to said front and back panels; a portion of said one panel which is separable along the line of weakening being superimposed over said flap and being connected to one of said front and back panels by attaching means; registration means including chip elements in abutting engagement with and unattached to said marginal edges for immobilizing said insert material relative to said front and back panels, said chip elements being adhesively secured to said front and back panels; and a tear strip on each said sealed envelope for opening said sealed envelope, said portion of said one panel being retained with said sealed envelope upon the removal of said return envelope from said sealed envelope.

2. The envelope assembly according to claim 1, wherein said tear strip is located along one end of said front and back panels, and said line of weakening is disposed perpendicular to said tear strip.

3. The envelope assembly according to claim 1, wherein said chip elements include portions of said insert material which have been severed therefrom at said marginal edges.

4. The envelope assembly according to claim 1, wherein said chip elements include registration blocks located at opposite side edges of said insert material and being defined by portions of said insert material extending outwardly of said side edges, said portions being severed by cuts extending through one of said front and back panels.

5. The envelope assembly according to claim 4, wherein said registration blocks are secured to said envelope panels by means of glue spots confined within holes provided in said blocks.

6. The envelope assembly according to claim 5, wherein said U-shaped chip elements are defined by partially severed portions of said insert material extending outwardly of said marginal edges, the remaining portions of said chip elements being severed from said insert sheet by cuts extending through one of said front and back panels.

7. The envelope assembly according to claim 1, wherein said chip elements are substantially U-shaped and abut against opposite end edges and portions of opposite side edges of said insert material.

* * * * *